United States Patent [19]

Fujisawa

[11] Patent Number: 4,718,383

[45] Date of Patent: Jan. 12, 1988

[54] THROTTLE BODY FOR FUEL INJECTION SYSTEM

[76] Inventor: Takashi Fujisawa, c/o Kabushiki Kaisha Honda Gijutsu Kenkyusho 4-1, Chuo 1-chome, Wako-shi Saitama-ken, Japan

[21] Appl. No.: 902,927

[22] Filed: Sep. 2, 1986

[30] Foreign Application Priority Data

Sep. 2, 1985 [JP] Japan ..... 60-134656[U]

[51] Int. Cl.[4] ..... F02M 7/00

[52] U.S. Cl. ..... 123/442; 123/445; 261/44.1

[58] Field of Search ..... 123/442, 445, 437, 438, 123/439, 301, 302, 585, 586; 261/44.7, 44 R, 64.3, 64 B; 60/691; 73/861.53

[56] References Cited

U.S. PATENT DOCUMENTS

| | | | |
|---|---|---|---|
| 3,807,367 | 4/1974 | Lamm | 123/442 |
| 4,276,862 | 7/1981 | Matsumoto | 123/442 |
| 4,308,837 | 1/1982 | Nohira et al. | 123/442 |
| 4,317,374 | 3/1982 | Casey | 123/442 |
| 4,318,273 | 3/1982 | Nohira et al. | 123/442 |
| 4,378,000 | 3/1983 | Moriya et al. | 123/442 |

*Primary Examiner*—Raymond A. Nelli
*Attorney, Agent, or Firm*—Steele, Gould & Fried

[57] ABSTRACT

A throttle body for a fuel injection system of an internal combustion engine, comprising an air valve and a throttle valve which are arranged in series in an intake bore defined in the throttle body, and a fuel injection nozzle which is adapted to inject fuel into the intake bore. The air valve is biased by a spring towards its closing direction and can be opened by the air flow hitting the air valve and/or by a vacuum actuator which tends to increase the opening angle of the air valve according the magnitude of the negative pressure existing in the intake bore between the air valve and the throttle valve. The throttle body further comprises for instance a solenoid valve which prohibits the action of the actuator when the engine has not been warmed up, when the rotational speed of the engine is not sufficiently high, or when the opening angle of the throttle valve is not sufficiently great. A timer prevents abrupt opening of the air valve even when all the conditions for opening the air valve have been met for the purpose of preventing the air/fuel mixture from becoming over lean.

6 Claims, 3 Drawing Figures

THROTTLE BODY FOR FUEL INJECTION SYSTEM

TECHNICAL FIELD

The present invention relates to a throttle body for a fuel injection system of an internal combustion engine and in particular to such a throttle body which has a pair of valves arranged in series in an intake bore defined in a main body of the throttle body.

BACKGROUND OF THE INVENTION

Fuel injection in an internal combustion engine can be effected either by providing a fuel injection nozzle to each cylinder of the engine or by providing a single fuel injection nozzle in a throttle body which is common to more than one cylinder. Favorable atomization of the fuel is highly desirable in any fuel injection system, and in the case of the throttle body fuel injection it is possible to improve the quality of the atomization of fuel by providing an air valve upstream of the throttle valve and increasing the air speed in the intake bore of the throttle body so that fuel may be injected into the air flow of relatively high speed resulting from the narrowing of the intake bore by the air valve.

For instance, U.S. Pat. No. 4,378,000 teaches such an air valve which can be opened by the increase in the air flow against the biasing force of a spring which tends to close the air valve. Alternatively or additionally, it is possible to use the negative pressure existing in the intake manifold for the purpose of driving the air valve and in this case an action similar to that of a variable venturi structure which can be seen in some of conventional carburetors can be accomplished.

However, since the opening angle of the air valve is substantially determined by the opening angle of the throttle valve, the atomization of the fuel tends to be insufficient when the engine has not been warmed up. It is possible to provide an electric heater in the intake bore of a throttle body so as to promote the evaporation of fuel in the intake bore as proposed by Japanese Patent Laying Open Publication No. 56-855555, but it makes the structure of the throttle body very comples and therefore expensive to manufacture.

BRIEF SUMMARY OF THE INVENTION

In view of such problems of the prior art, a primary object of the present invention is to provide a throttle body comprising an air valve and a throttle valve in series which can effect favorable atomization of fuel even when the engine has not been warmed up.

A second object of the present invention is to provide such a throttle body which has a means for preventing the opening of the air valve as required so that the favorable atomization of fuel can be accomplished under all conditions.

A third object of the present invention is to provide such a throttle body which is simple in structure and is therefore reliable in use and economical for manufacture.

According to the present invention, such an object is accomplished by providing a throttle body for a fuel injection system of an internal combustion engine, comprising: a main body defining an intake bore therein; an air valve provided at an upstream location in the intake ore; a throttle valve provided at a downstream location in the intake bore; a fuel injection nozzle which is adapted to inject fuel into the intake bore; a biasing means for biasing the air valve towards its closed state; an actuator which tends to increase the opening angle of the air valve according the magnitude of the negative pressure existing in the intake bore between the air valve and the throttle valve; a prohibiting means which prohibits the action of the actuator when the engine has not been warmed up.

Thus, when the engine has not been warmed up and the atomization of fuel is difficult because of low temperature, the air valve is prevented from opening and favorable atomization of fuel is thereby promoted.

According to a certain aspect of the present invention, the actuator comprises a diaphragm which responds to the negative pressure existing in the intake bore between the air valve and the throttle valve.

According to another aspect of the present invention, the action of the actuator or, in other words, opening of the air valve is prohibited when the rotational speed of the engine is less than a certain value, or when the opening angle of the throttle valve is less than a certain value.

According to yet another aspect of the present invention, the prohibiting means comprises a timer which prohibits the action of the actuator for a certain time internal after all the conditions for opening the air valve are met. Thereby, the air valve is prevented from opening abruptly and making the air/fuel mixture over-lean even when all the conditions for permitting the opening of the air valve have been met.

According to yet another aspect of the present invention, the air valve comprises a valve body consisting of a planar plate and a valve shaft which is perpendicular to the axial line of the intake bore and pivotably supports the valve body about a diagonal line of the valve body which divides the valve body into two parts having different surface areas. Thus, the air valve can be opened by the increase in the air flow in the intake bore and a favorable action of the air valve can be effected.

BRIEF DESCRIPTION OF THE DRAWINGS

The present invention will now be shown and described in the following in terms of a concrete embodiment thereof with reference to the appended drawings, in which.

DETAILED DESCRIPTION OF THE PREFERRED EMBODIMENT

Figure 1:
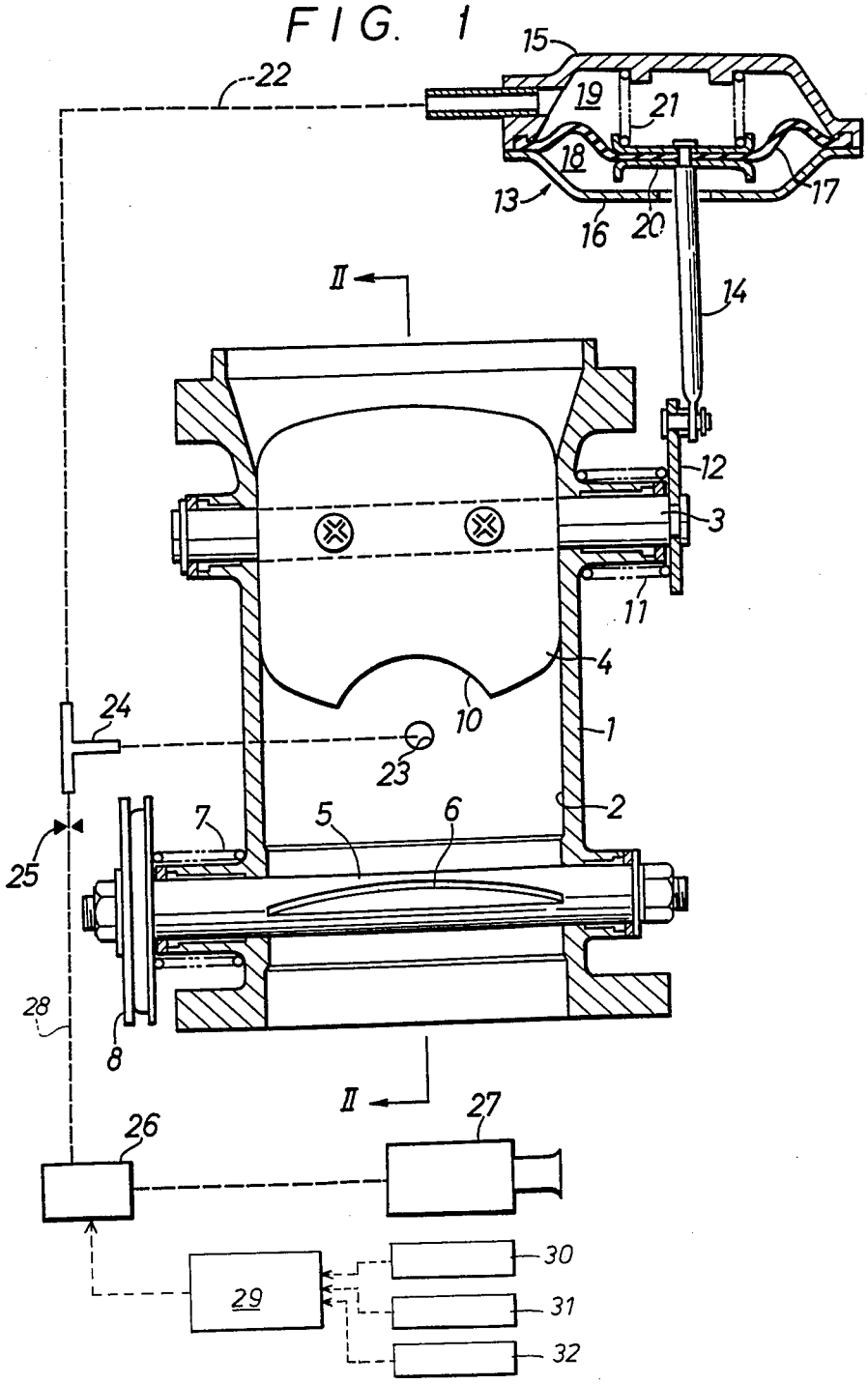
FIG. 1 is a sectional view of an embodiment of the throttle body according to the present invention.
Figure 2:
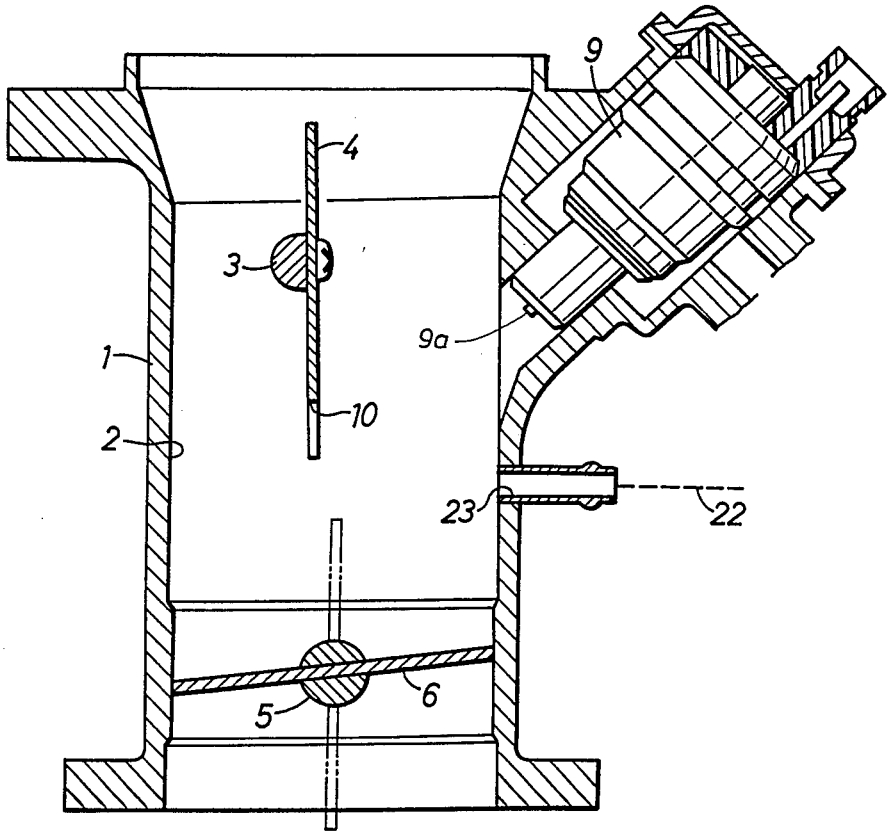
FIG. 2 is a sectional view taken along line II—II of FIG. 1.

FIGS. 1 and 2 shows the overall views of a throttle body for fuel injection control according to an embodiment of the present invention, and a main body 1 of the throttle body internally defines an intake bore 2 of a circular cross section. The upstream end of the intake bore 2 which communicates with an air cleaner is provided with an air valve 4 by way of a valve shaft 3 which is perpendicular to the axial line of the intake bore 2 and is offset relative to the corresponding diametral ine of the intake bore 2. In other words, the valve shaft 3 divides the valve body of the air valve 4 into two parts having different surface areas. The air valve is urged by a torsion coil spring 11 which is towards its fully closed position. The downstream end of the intake bore 2 which communicates with an intake manifold (which is also not shown in the drawings) is provided with a throttle valve 6 which is supported by another valve shaft 5 which is aligned with a diametral line of the intake bore 2. The valve shaft 5 of the throttle valve 6 is biased to its fully closed position by a torsion coil spring 7 which is wound on an external end of the valve shaft 5 in a concentric relationship and is adapted to be driven by a throttle pulley 8 which is securely attached to the outer most end of the valve shaft 5.

A fuel injection valve 9 is obliquely mounted to the main body 1 of the throttle body in such a manner that the nozzle 9*a* of the fuel injection valve 9 opens at the portion of the intake bore 2 which is located slightly downstream of the valve shaft 3 of the air valve 4 and is directed to the valve shaft 5 of the throttle valve 6. The portion of the air valve 4 which can come adjacent to the nozzle opening of the fuel injection valve 6 is provided with a cut-out 10 so as to prevent any interference between the air valve 4 and the fuel injection valve 9 and to define an air passage even when the air valve 4 is fully closed.

The valve shaft 3 of the air valve 4 is biased in closing direction by a torsion coil spring 11 which surrounds an external end of the valve shaft 3 and one end of a rod 14 of a vacuum actuator 13 is connected to a free end of an arm 12 which is fixed secured to the outer most end of the valve shaft 3. This vacuum actuator 13 comprises a pair of casing halves 15 and 16 which are held together by threaded bolts passed therethrough interposing a diaphragm therebetween 17 so as to define an atmospherc chamber 18 and a negative pressure chamber 19.

The diaphragm 17 is connected to the other end of the rod 14 by way of a retainer 29 for the diaphragm 17 and is biased towards the atmospheric chamber 18 by a compression coil spring 21 which is received in the negative pressure chamber 19. The atmospheric chamber 18 is directly communicated with the atmosphere while the negataive pressure chamber 19 is communicated with a negative pressure port 23 which opens into the portion of the intake bore 2 located between the air valve 4 and the throttle valve 6, by way of a conduit 22.

The conduit 22 is connected to a branch conduit 28 by way of a T shaped fitting 24 and this branch conduit 28 is connected to the interior of an air cleaner 27 or the atmosphere by way of a jet orifice 25 and an electromagnetic valve 26 which is controlled by a control unit 29. The control unit 29 comprises a micro processor therein and receives signals from a temperature sensor 30 which detects the temperature (Tw) of the cooling water of the iternal combustion engine, an engine speed sensor 31 which detects the rotational speed (Ne) of the engine, and a throttle opening sensor 32 which detects the opening angle (Th) of the throttle valve 6.

Figure 3:
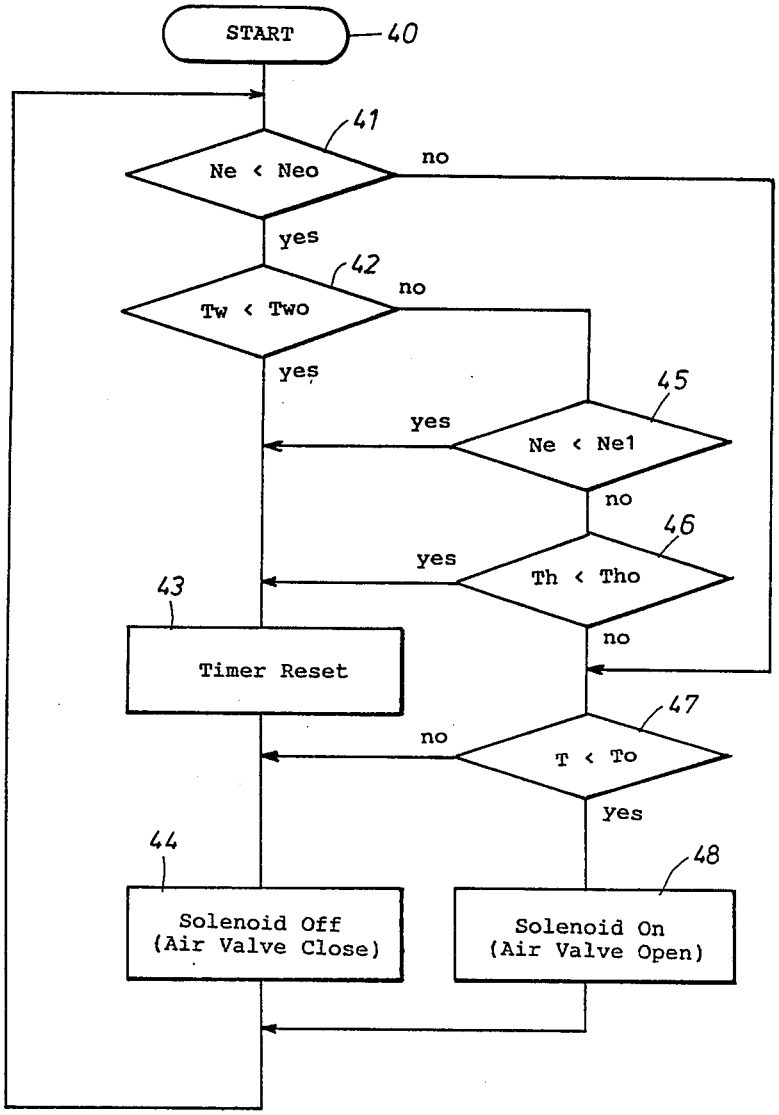
FIG. 3 is a flow chart illustrating the control action of the throttle body given in FIGS. 1 and 2.

Now the action of the present embodiment is described in the following with reference made to the flow chart given in FIG. 3.

When the system is started up (step 40) all the parameters are initialized. In step 41 it is determined whether the rotational speed (Ne) of the engine is lower than a certain value (Neo), for instance 1,000 rpm, or not. If Ne<Neo or, in other words, the rotational speed of the engine is low, the process flow advances to step 42 and it is determined whether the temperature (Tw) of the cooling water of the engine is lower a certain value (Two) or not. Tw may be for instance 60° C. If the Tw<Two or, in other words, the engine has not been sufficiently wramed up, the process flow advances to step 43 and resets a timer which is internally provided in the microprocessor of the control unit 29. Then the solenoid valve 26 is turned off or, in other words, the negative pressure chamber 19 of the vacuum actuator 13 is communicated with the atmosphere and the air valve 4 is substantially closed by the biasing force of the torsion coil spring 11 and the compression coil spring 21 (step 44). In this state, since the valve shaft 3 of the air valve 4 is offset relative to the center of the intake bore 2, the air valve 4 can be opened by the intake air to the extent the biasing forces of the springs 11 and 13 permit. Then the system flow returns to step 41 and repeats the above described process.

If Ne>=Neo or, in other words, the rotational speed (Ne) of the engine is sufficiently high in step 41, the system flow advances to step 47 and it is determined whether the time (T) on the timer is less than a certain value (To) or not. T may be, for instance, 0.4 seconds. If T<To, the system flow advances to step 44 and the air valve 4 is kept closed. In this stage, since the rotational speed (Ne) of the engine is sufficiently high, the air valve 4 could be opened without impairing the quality of the atomization of fuel. However, since it has been found that if the air valve is opened abruptly the air/fuel mixture that is goint to be supplied to the engine tends to be over lean and it is therefore desirable to provide a certain delay before opening the air valve 4 even when the conditions for opening the air valve 4 have been met. The timer is intended to provide such a delay. The reason for this phenomenon is not quite fully understood but is appears that it has to do with the existence of fuel that wets the surfaces of the air valve 4 and the intake bore 2. Thus, if Ne continues to be higher than Neo, the time T on the timer will eventually exceed the certain value (To) as the system flow repeats steps 47, 44 and 41 and the solenoid valve 26 is closed or, in other words, the air valve 4 can be opened by the vacuum actuator 13 to the extent the negative pressure existing in the intake bore 2 between the air valve 4 and the throttle valve 6 permits (step 48).

If Ne<Neo (step 41) and the cooling water temperature (Two) exceeds the certain value (Two) (step 42), the system flow advances to step 45 and it is determined whether the rotational speed (Ne) of the engine is less than a second certain value (Ne1) which is higher than the first certain value (Neo) and may be, for instance, 1,200 rpm, or not. If Ne<Ne1, since the engine speed is relative low although the engine has been warmed up and the quality of the atomization of fuel is required to be improved, the system flow advances to step 43 to reset the timer and to step 44 to close the air valve 4.

If the rotational speed (Ne) of the engine is sufficiently high in step 45, the system flow advances to step 46 to determine whether the opening angle (Th) of the throttle valve 6 is less than a certain value (Tho) or not. Tho may be for instance 20 degrees. If Th<Tho or, in other words, the throttle valve 6 is substantially closed, the quality of the atomization of fuel is not a significant problem and, therefore, the system flow advances to steps 43 and 44 to close the air valve 4.

If the opening angle (Th) of the throttle valve 6 is sufficiently great in step 46, the system flow advances to step 47 and, if this state has persisted for more than the certain time interval (To) which may be 0.4 seconds, the system flow advances to step 48 and the air valve 4 can be now opened by the vacuum actuator 13. Since the air valve 4 produces a resistance to the air flow in the intake bore 2, the air valve 4 should be closed whenever the quality of the atomization of fuel is not a significant problem.

Thus, according to the present invention, since the opening angle of the air valve 4 depends on the negative pressure downstream of the air valve 4 on one hand and the negative pressure existing downstream of the air valve depends on the opening angle of the air valve and the negative pressure existing downstream of the air valve 4, and the intake negative pressure in the vicinity of the nozzle opening 9*a* of the fuel injection valve 9 can be kept at a substantially constant level and the quality of the atomization of fuel can be controlled in a stable manner. Furthermore, since the opening of the air valve is prohibited when certain conditions hold as given by steps 41, 42, 45, 46 and 47, the quality of the atomization of fuel can be maintained at a favorable level irrespective of the temperature of the cooling water, the rotational speed of the engine and the opening angle of the throttle valve, and, additionally, the abrupt opening of the air valve 4 which can make the air/fuel mixture over lean is prevented.

Although the present invention has been shown and described with reference to the preferred embodiment thereof, it should not be considered as limited thereby. Various possible modifications and alterations could be conceived of by one skilled in the art to any particular embodiment, without departing from the scope of the invention.

What I claim is:

1. A throttle body for a fuel injection system of an internal combustion engine, comprising:

a main body defining an intake bore therein;

an air valve provided at an upstream location in the intake bore;

a throttle valve provided at a downstream location in the intake bore;

a fuel injection nozzle which is adapted to inject fuel into the intake bore;

a biasing means for biasing the air valve towards its closed state;

an actuator which tends to increase the opening angle of the air valve according the magnitude of the negative pressure existing in the intake bore between the air valve and the throttle valve;

a prohibiting means which prohibits the action of the actuator when the engine has not been warmed up.

2. A throttle body for a fuel injection system of an internal combustion engine as defined in claim 1, wherein the actuator comprises a diaphragm which responds to the negative pressure existing in the intake bore between the air valve and the throttle valve.

3. A throttle body for a fuel injection system of an internal combustion engine as defined in claim 2, wherein the prohibiting means prohibits the action of the actuator when the rotational speed of the engine is less than a certain value.

4. A throttle body for a fuel injection system of an internal combustion engine as defined in claim 3, wherein the prohibiting means prohibits the action of the actuator when the opening angle of the throttle valve is less than a certain value.

5. A throttle body for a fuel injection system of an internal combustion engine as defined in claim 4, wherein the prohibiting means comprises a timer which prohibits the action of the actuator for a certain time interval after all the conditions for opening the air valve are met.

6. A throttle body for a fuel injection system of an internal combustion engine as defined in any one of claims 1 to 5, wherein the air valve comprises a valve body consisting of a planar plate and a valve shaft which is perpendicular to the axial line of the intake bore and pivotably supports the valve body about a diagonal line of the valve body which divides the valve body into two parts having different surface areas.

* * * * *

UNITED STATES PATENT AND TRADEMARK OFFICE

CERTIFICATE OF CORRECTION

PATENT NO. : 4,718,383

DATED : January 12, 1988

INVENTOR(S) : Takashi Fujisawa

It is certified that error appears in the above-identified patent and that said Letters Patent is hereby corrected as shown below:

Column 1, line 43, delete "comples" and insert --complex-- therefor.

Signed and Sealed this

Twenty-eighth Day of March, 1989

*Attest:*

DONALD J. QUIGG

*Attesting Officer*

*Commissioner of Patents and Trademarks*